United States Patent [19]

Suefuji et al.

[11] Patent Number: 4,904,170

[45] Date of Patent: Feb. 27, 1990

[54] SCROLL-TYPE FLUID MACHINE WITH DIFFERENT TERMINAL END WRAP ANGLES

[75] Inventors: Kazutaka Suefuji, Shimizu; Takao Senshu, Shizuoka; Tetsuya Arata, Shimizu; Masatoshi Muramatsu, Shimizu; Jyoji Okamoto, Shimizu; Akira Murayama, Shimizu, all of Japan

[73] Assignee: Hitachi, Ltd., Tokyo, Japan

[21] Appl. No.: 233,000

[22] Filed: Aug. 17, 1988

[30] Foreign Application Priority Data

Aug. 21, 1987 [JP] Japan ..... 62-207505

[51] Int. Cl.[4] ..... F01C 1/04

[52] U.S. Cl. ..... 418/55; 418/150

[58] Field of Search ..... 418/55 A, 150

[56] References Cited

U.S. PATENT DOCUMENTS 4,645,436 2/1987 Sakamoto ..... 418/55 A

FOREIGN PATENT DOCUMENTS 55-37537 3/1980 Japan .

56-28239 6/1981 Japan .

2149857 6/1985 United Kingdom ..... 418/55 A

*Primary Examiner*—John J. Vrablik

*Attorney, Agent, or Firm*—Antonelli, Terry & Wands

[57] ABSTRACT

A scroll-type fluid machine comprises a stationary scroll member, an orbiting scroll member, a rotation-prevention mechanism for the orbiting scroll member, and a casting accommodating therein both members and the mechanism. The involute angle of a terminal end of a wrap of the orbiting scroll member is selected to be less than that of the wrap of the stationary scroll member by an angle which ranges between 60° and 120°, preferably, about 90°, thereby reducing a level of force applied to the rotation-prevention mechanism which prevents the orbiting scroll member from rotating about its own axis.

8 Claims, 4 Drawing Sheets

SCROLL-TYPE FLUID MACHINE WITH DIFFERENT TERMINAL END WRAP ANGLES

BACKGROUND OF THE INVENTION

The present invention relates to a scroll-type fluid machine such as a scroll compressor and, more particularly, to a scroll-type fluid machine in which an outside diameter of the fluid machine is reduced to realize a compact design and a force applied to rotation-prevention mechanism is reduced to provide a higher durability of the machine.

Conventional scroll-type fuid machines include an orbiting scroll member and a stationary scroll member, with the orbiting scroll member having a disk-shaped plate and an involute or substantially involute spiral wrap which protrudes upright from one end surface of the plate, and the stationary scroll member having a construction similar to that of the orbiting scroll member with a discharge port formed in a center of the plate. The orbiting scroll member and the stationary scroll member are assembled together such that the wraps of these members mesh each other while making sliding contact at side surfaces of these wraps. The orbiting scroll member and the stationary scroll member are placed into a hermetic cylindrical casing which is provided with a suction port. The stationary scroll member is fixed to the casing while the orbiting scroll member is driven through a crank pin of a crank shaft connected to, for example, an electric motor while being prevented from rotating about its own axis by a rotation-prevention mechanism, in such a manner that the center of the wrap of the orbiting scroll member revolves about the center of the wrap of the stationary scroll member, i.e., about the center of the involute base circle of the wrap of the stationary scroll member, while maintaining the sliding contact between the side walls of the scroll wraps of both scroll members. As a result of the orbiting motion of the orbiting scroll member, closed spaces formed between the wraps of both scroll members, constituting compression chambers, are progressively moved towards the center of the stationary scroll member while progessively decreasing their volumes, until they are brought into communication with the discharge port formed in the center of the plate of the stationary scroll member. Consequently, gas confined in the compression chamber is compressed to a level higher than the suction pressure before it is discharged through the discharge port in the center of the plate of the stationary scroll member.

Demand is increasing for scroll compressors having smaller sizes in order to meet the requirement for saving installation space and, to cope with such a demand, Japanese Patent Examined Publication No. 56-28239 discloses a scroll compressor which is referred to as scroll compressor of "symmetric eccentricity wrap type". In this type of scroll compressor, the involute angle of the terminal end on the spiral wrap of the orbiting scroll member is the same as the involute angle of the terminal end of the scroll wrap of the stationary scroll member. In addition, the center of the involute base circle of the wrap on the orbiting scroll member is offset by an amount $\epsilon/2$ from the center of the plate thereof in a direction opposite to the terminal end of the wrap, where $\epsilon$=a radius revolution and corresponds to a length of a crank arm of a crank. At the same time, the center of the involute base circle of the wrap on the stationary scroll member is offset by the same amount $\epsilon/2$ from the center axis of the casing towards the terminal end of the wrap on the stationary scroll member. With such symmetrical offset arrangement of both scroll wraps, it is possible to minimize the diameter of the plate of the orbiting scroll member and, hence, to minimize the inside diameter of the casing. The scroll compressor of symmetrical eccentricity wrap type, which appreciably contributes to the reduction in the size of the casing, suffers from a disadvantage in that the maximum value of the torque applied to the orbiting scroll member, tending to rotate this member about its own axis, is increased due to the radius of the point on which the gas pressure load acts, so that the rotation-prevention mechanism is heavily loaded thereby resulting in increased friction and wear in the rotation-prevention mechanism, thus seriously impairing the durability of the scroll compressor.

SUMMARY OF THE INVENTION

Accordingly, an object of the present invention is to provide a scroll-type fluid machine which can reduce the diameter of the casing thereof and reduce the torque applied to the rotation-prevention mechanism, thereby realizing a compact design and improved durability of the scroll-type fluid machine.

To this end, according to the present invention, there is provided a scroll-type fluid machine comprising a cylindrical casing, a stationary scroll member and an orbiting scroll member each member having a disk-shaped plate and a spiral wrap protruding upright from one end of the plate along an involute curve of a circle, the stationary scroll member and the orbiting scroll member being assembled together such that their wraps mesh each other and are received in the casing, with the orbiting scroll member being capable of making, without rotating about its own axis, an orbiting motion such that the center of the basic circle of involute curve of the wrap on the orbiting scroll member revolves at a predetermined radius of revolution about the center of the basic circle of the involute curve of the wrap on the stationary scroll member while keeping sliding contact between the walls of wraps on both scroll members. The involute angle of the terminal end of the wrap on the stationary scroll member is greater than the involute angle of the terminal end of the wrap on the orbiting scroll member, that the center of the basic circle of the involute curve of the wrap on the orbiting scroll member coincides with the center of the plate of the orbiting scroll member while the center of the basic circle of the involute curve of the wrap on the stationary scroll member coincides with or substantially coincides with the center axis of the casing. The terminal end of the wrap on the orbiting scroll member is located substantially on the outer peripheral edge of the plate of the orbiting scroll member while the terminal end of the wrap on the stationary scroll member is located substantially on the inner peripheral surface of the casing, and the involute angle $\lambda_{ef}$ of the terminal end of the wrap on the stationary scroll member and the involute angle $\lambda_{eo}$ of the terminal end of the wrap on the orbiting scroll member are determined to meet the following condition:

$$60^\circ \leqq \lambda_{ef} - \lambda_{eo} \leqq 120^\circ$$

According to another aspect of the present invention, there is provided a scroll-type fluid machine comprising a stationary scroll member having a first disk-shaped plate and a first involute spiral wrap protruding upright from one end of the first plate, with the center of a basic circle of the first involute spiral wrap coinciding with the center of a casing surrounding the first plate. The terminal end of the first wrap is located substantially on the inner peripheral surface of the casing and an orbiting scroll member is provided having a second disk-shaped plate and a second involute spiral wrap protruding upright from one end of the second plate and meshing with the wrap of the stationary scroll member. The center of a basic circle of the second involute spiral wrap coincides with the center of the second plate, and the terminal end of the second wrap is located on a peripheral edge of the second plate. An involute angle of the terminal end of the second wrap of the orbiting scroll member is smaller than an involute angle of the terminal end of the first wrap of the stationary scroll member by an angle which is substantially equal to or slightly less than 90°.

According to still another aspect of the present invention, there is provided a scroll-type fluid machine comprising a stationary scroll member having a disk-shaped plate and a first involute spiral wrap protruding upright from one end of the plate, with the center of a basic circle of the first involute spiral wrap coinciding with the center of a casing surrounding the stationary scroll member. The terminal end of the first wrap is located substantially on an inner peripheral surface of the casing, and an orbiting scroll member is provided having a disk-shaped plate and a second involute spiral wrap protrudcing upright from one end of the plate and meshing with the first wrap of the stationary scroll member. The center of a basic circle of the second involute spiral wrap coincides with the center of the plate of the orbiting scroll member, and the terminal end of the second wrap is located on a peripheral edge of the plate thereof thickness of the second wrap of the orbiting scroll member is substantially equal to the radius of revolution of the orbiting scroll member.

With these arrangements, it is possible to reduce the diameter of the casing to a value which is almost the same as the symmetric eccentricity wrap type machine having the same theoretical displacement, while reducing the torque which acts on the orbiting scroll member so as to rotate the same about its own axis.

These and other objects, features and advantages of the present invention will become clear from the following description of the preferred embodiments in conjunction with the accompanying drawings.

DESCRIPTION OF THE PREFERRED EMBODIMENTS

Figure 3:
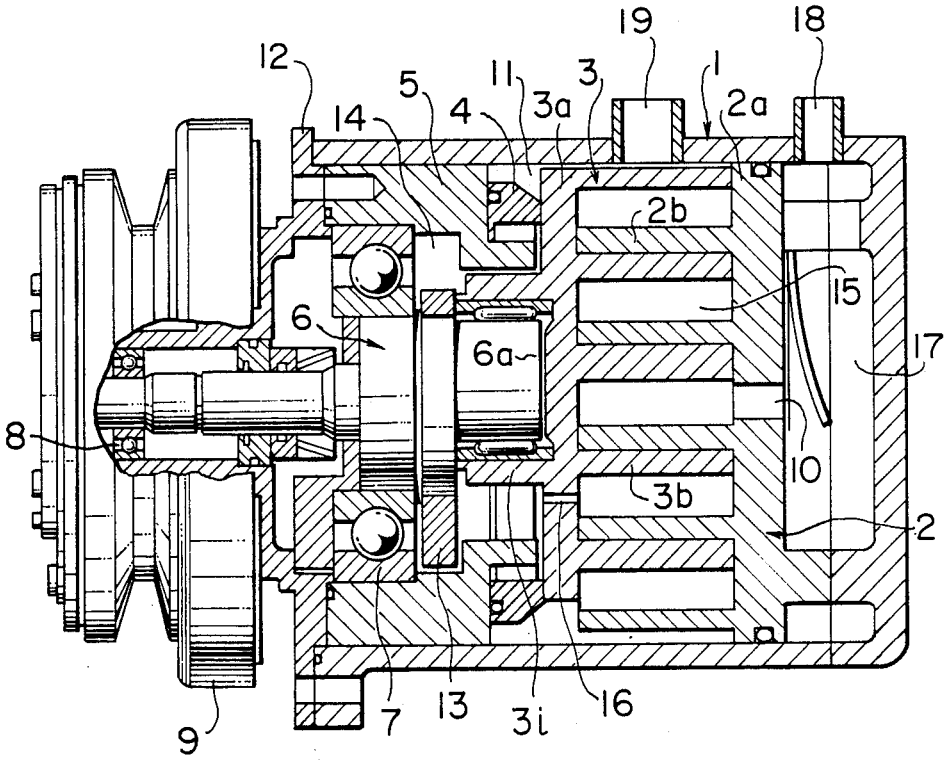
FIG. 3 is a vertical sectional view of the embodiment of the present invention.

As shown in FIG. 3, the scroll compressor has a cylindrical casing generally designated by the reference numeral 1 which accommodates a compressor unit composed of a stationary scroll member generally designated by the reference numeral 2 and an orbiting scroll member generally designated by the reference numeral 3 meshing with each other, an Oldham's ring 4 serving as a rotation-prevention means, a frame 5, and a driving unit including a crankshaft 6 and bearings 7, 8. The crankshaft 6 is extended to the exterior of the casing 1 and is connected to a clutch 9 which is disposed outside the casing 1.

The stationary scroll member 2 has a disk-shaped plate **2*a* and an involute or substantially involute spiral wrap 2*b* protruding upright from one end of the plate 2*a*. A discharge port 10 is formed in a center portion of the plate 2*a*. A suction chamber 11 is defined around the stationary scroll member 2. The orbiting scroll member 3 has a disk-shaped plate 3*a* and a spiral wrap 3*b* protruding upright from one end of the plate 3*a* and has a configuration the same as that of the wrap 2*b* on the stationary scroll member 2. The orbiting scroll member 3 further has a boss 3*i* provided on the opposite end of the plate 3*a*. The stationary scroll member 2 and the orbiting scroll member 3 are assembled together such that their wraps 2*b* and 3*b* mesh each other in sliding contact with each other so as to form compression chambers 15 therebetween. The crank shaft 6 is supported by the bearing 7 provided on the radial center portion of the frame 5 and the bearing 8 provided on the radial center portion of an end plate 12 of the casing 1. The crankshaft 6 is provided at its end with a crank pin serving as an eccentric shaft portion 6*a* which is received in a recess of the boss 3*i* for rotation therein. A chamber formed on a rear side of the plate 3*a* accommodates the bearing 7 and a balance weight 13 fixed to the crankshaft 6. This chamber is separated from the suction chamber 11 by the Oldham's ring 4 to form a sealed back-pressure chamber 14. The Oldham's ring 4 has a sealing portion disposed between a rear end of the plate 3*a* and the frame 5. A through hole 16 is formed in the plate 3*a* so as to provide communication between the back-pressure chamber 14 and a portion of the compression chamber 15 in which the pressure is under a suitable level of pressure in the course of the compression. Consequently, a pressure of a level intermediate between the suction pressure and the discharge pressure is maintained in the back-pressure chamber 14 so that the orbiting scroll member 3 is pressed against the stationary scroll member 2 to seal the compression chambers 15. A discharge chamber 17 is defined between the casing 1 and the plate 2*a* of the stationary scroll member 2, which communicates with the discharge port 10 and a discharge pipe 18 connected to the casing 1. A suction pipe 19 connected to the casing 1 communicates with the suction chamber 11**.

In operation, the crankshaft 6 is rotatingly driven through the clutch 9 so that the eccentric shaft portion **6*a* performs an eccentric revolution to cause the orbiting scroll member 3 to conduct an orbiting motion at a radius of revolution $\epsilon$ without rotating about its own axis while keeping sliding contact between the wraps 2*b* and 3*b* of both scroll members. Consequently, the compression chamber 15 is moved towards the center of the stationary scroll member 2 while decreasing its volume progressively. Gas such as refrigerant of low temperature and low pressure sucked into the compression chamber 15 from the suction chamber 11 through the suction pipe 19 is progressively compressed and finally discharged into the discharge chamber 17 through the discharge port 10, whereby refrigerant gas of high temperature and high pressure is delivered to the outside of the compressor through the discharge pipe 18**.

Figure 1:
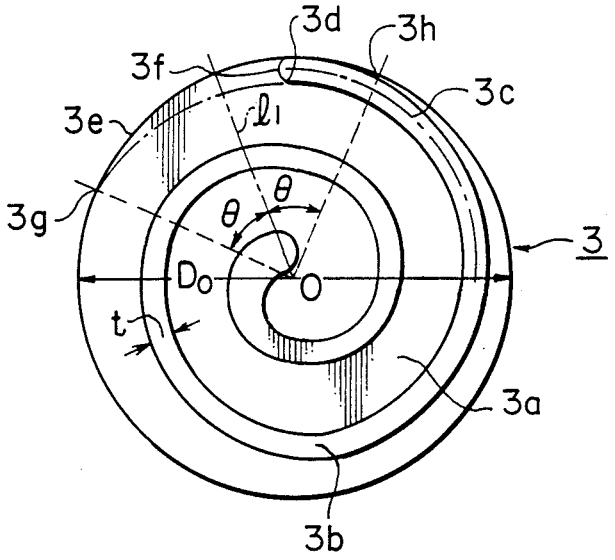
FIG. 1 is a plan view of an orbiting scroll member of an embodiment in accordance with the present invention.

As shown mast clearly in FIG. 1, the orbiting scroll member 3 has a disc-shaped plate 3a and an involute spiral wrap 3b protruding upright, i.e., in an axial direction, from one end of the plate 3a. The center of a basic circle of the involute curve of the wrap 3b coincides with the center O of the plate 3a which also coincides with the center of the eccentric shaft portion 6a. The involute curve 3c which is a thicknesswise bisector line of the wrap 3b intersects the peripheral edge 3e of the plate 3a at a point 3f. The terminal end 3d of the wrap 3b is located on a portion of the peripheral edge 3e, which is within an angular $\pm\theta$ from the line $l_1$ which interconnects the point 3f and the center O, i.e., within a range between points 3g and 3h as shown in FIG. 1.

The angle $\theta$ is determined to meet the condition of the following equation (1).

$$\theta = \frac{t}{2a} \tag{1}$$

where, t represents the thickness of the wrap while a represents the radius of the basic circle. Since a condition of $\pi a = \epsilon + t$ is met ($\epsilon$ represents a radius of revolution), the equation (1) can be transformed into the following equation (2).

$$\theta = \frac{\pi t}{2(\epsilon + t)} \tag{2}$$

Figure 6:
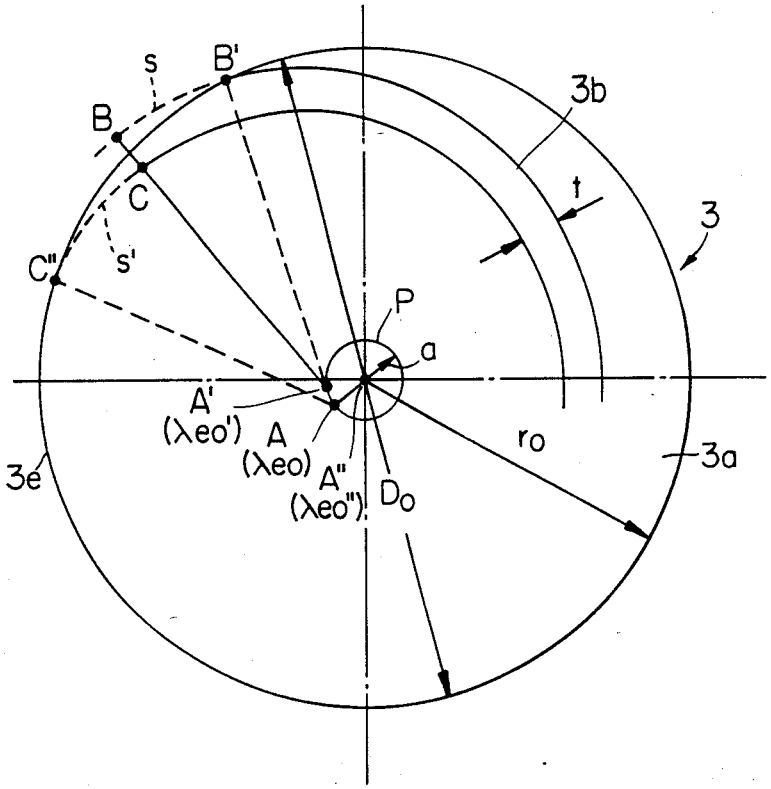
FIG. 6 is a diagrammatic view illustrating the conditions for determining a location of a terminal wrap end of an orbiting scroll member.

In FIG. 6, presuming an actual angle of the terminal end of the wrap is $\lambda_{eo}$, a contact point between the involute basic circle P having a radius a and a base line is a point A, and extended curve S corresponding to an outer surface of the wrap 3b is an imaginary terminal end point B, and a terminal end of a curve S' corresponding to an inner surface of the wrap 3b is defined by a point C, the following relationships are obtained.

$$\overline{AB} = a\lambda_{eo} \tag{3}$$

$$\overline{AC} = a\lambda_{eo} - t \tag{4}$$

where:

a = a radius of curvature of the basic circle P; and t = the thickness of the wrap 3b.

Additionally, presuming that an intersection between the outer peripheral edge 3e of the disk-shaped plate 3a and an outer surface of the wrap 3b is a point B', an involute angle at the point B' is $\lambda'_{eo}$, an intersection point between the outer peripheral edge 3e of the disk 3a and the extended curve S' corresponding to the inner surface of the wrap 3b is a point C'', and an involute angle at the point C'' is $\lambda''_{eo}$, the following relationships are obtained.

$$\overline{A'B'} = a\lambda'_{eo} \tag{5}$$

$$\overline{A''C''} = a\lambda''_{eo} - t \tag{6}$$

$$\overline{A'B'} \simeq \gamma_o = D_o/2 \tag{7}$$

$$\overline{A''C''} \simeq \gamma_o = D_o/2 \tag{8}$$

where:

$\gamma_o$ = radius of the disc-shaped plate 3a; and $D_o$ = diameter of the disc-shaped plate 3a';

By simple substitution in terms in the relationships (7) and (8), the following relationships are obtained:

$$\overline{2A'B'} = 2a\lambda'_{eo} \simeq D_o \tag{9}$$

$$\overline{2A''C''} = 2(a\lambda''_{eo} - t) \simeq D_o \tag{10}$$

Since $\overline{AB} \geqq A'B'$ and $\overline{AC} < A''C''$ when applying these conditions to relationships (9) and (10), the following relationships are obtained:

$$2\overline{AB} \geqq \overline{2A'B'} \simeq D_o \tag{11}$$

$$2\overline{AC} < \overline{2A''C''} \simeq D_o \tag{12}$$

By simple substitution in relationships (11) and (12) the following relationships are obtained:

$$2a\lambda_{eo} \geqq D_o \tag{13}$$

$$2(a\lambda_{eo} - t) < D_o \tag{14}$$

The following equation (15) is obtained from the above-described conditions concerning the location of the terminal end of the wrap.

$$2(a\lambda_{eo} - t) < D_O \leqq 2a\lambda_{eO} \tag{15}$$

Referring again to FIG. 1, the thickness of the wrap 3b is reduced to zero a the point 3g. If it is necessary to extend the wrap 3b beyond this point 3g, it is necessary to increase the diameter $D_O$ of the plate 3a, resulting in an undesirable increase in the size of the casing. The outer peripheral surface of the wrap 3b merges in the outer peripheral edge of the plate 3a at the point 3h. If the wrap is designed to terminate short of the point 3h, the radially outermost periphery of the wrap 3b is located radially inwardly from the outer peripheral edge of the plate 3a. With such an arrangement, the space between the outer peripheral edge of the plate 3a and the outer periphery of the wrap 3b does not make any contribution to the operation of the scroll compressor. In other words, the size of the casing is increased wastefully. According to the invention, however, the size of the casing can be minimized because the terminal end 3d of the wrap 3b is located within the above-mentioned angular range.

Figure 2:
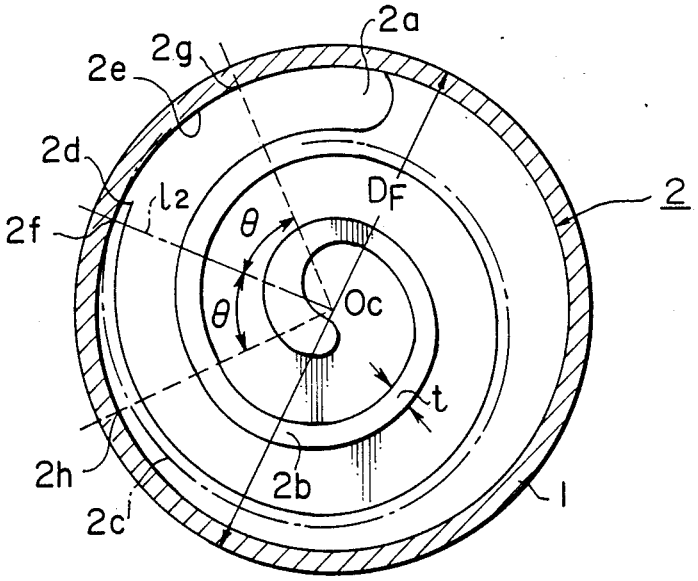
FIG. 2 is a partial cross-sectional plan view of a stationary scroll member of an embodiment in accordance with the present invention.

As shown in FIG. 2, the stationary scroll member 2 has a disk-shaped plate 2a having a diameter which is equal to the inside diameter of the casing 1 and a spiral wrap 2b formed along an involute curve and protruding upright, i.e., in an axial direction, from one end of the plate 2a. The center of the basic circle of the involute coincides with the center $O_C$ of the casing 1. The involute curve which is a thicknesswise bisector of the wrap 2b intersects the inner peripheral surface 2e of the casing 1 at a point 2f. The terminal end 2d of the wrap 2b is located on a portion of the outer peripheral edge 2e of the plate 2a within an angular $\pm\theta$ from a line $l_2$ which interconnects the point 2f and the center $O_C$, i.e., between points 2g and 2h as shown in FIG. 2. The value of the angle $\theta$ is determined in accordance with the equation (1) or (2). A condition expressed by the following equation (16) is obtained also on the stationary scroll member 2 in terms of $D_o$, $\lambda_{eo}$, $\lambda'_{eo}$, and $\lambda''_{eo}$ by replaing such terms by $D_f$, $\lambda_{ef}$, $\lambda'_{ef}$, and $\lambda''_{ef}$, respectively.

$$2(a\lambda_{ef}-t)<D_f\leqq 2a\lambda_{ef} \quad (16)$$

Thus, the diameter of the stationary scroll member and, hence, the diameter of the casing, can be reduced by locating the terminal end 2*d* of the wrap 2*b* within the angular range $\pm\theta$, as in the case of the orbiting scroll member 3.

In operation, the wrap 3*b* of the orbiting scroll member 3 is moved so as to slidably contact the wrap 2*b* of the stationary scroll member 2. The plate 3*a* of the orbiting scroll member 3 makes an orbiting motion within the casing 1 without rotaating about its own axis in such a manner that the center O revolves along a circle centered at $O_c$ at a radius $\epsilon$ which equals to the eccentricity of the eccentric shaft portion 6*a* from the axis of the crankshaft 6. This orbiting motion of the orbiting scroll member 3 is performed such that the plate 3*a* of the orbiting scroll member 3 travels over the entire inner diameter of the casing 1 without making any mechanical contact or interference with the inner periphery of the casing 1. Thus, the inner diameter of the casing 1 is determined to be equal to or slightly greater than the sum of the diameter of the plate 3*a* of the orbiting scroll member 3 and $2\epsilon$.

In the scroll-type fluid machine according to the present invention, the involute angle of the terminal end of the wrap of the stationary scroll member is designated to be greater than that of the wrap on the orbiting scroll member, as will be seen from FIGS. 1 and 2, thus providing an asymmetric wrap arrangement.

A comparison will be made hereinunder between the scroll-type fluid machine of the invention having the asymmetric wrap arrangement and a scroll-type fluid machine having the symmetric eccentricity wrap arrangement. In the fluid machine according to the present invention, the center lies of the wraps 3*b*, 2*b* of the orbiting scroll member 3 and the stationary scroll member 2 intersect at the points 3*f* and 2*f*, respectively, as shown in FIGS. 1 and 2. It is assumed here that the factors in the fluid machine of the invention such as the diameter of the end plate of the orbiting scroll member, diameter of the end plate of the stationary scroll member, diameter of the basic circle of the involute curve and the radius of the circle along which the orbiting scroll member revolves are determined to be equal to those in the scroll-type fluid machine of the symmetrical eccentricity wrap type. In such a case, the involute angle of the terminal end of the wrap of the orbiting scroll member is less than that in the fluid machine of the symmetrical eccentricity wrap type by an amount in terms of radians determined by dividing the radius of revolution by the basic circle diameter, i.e. ($\epsilon$/2a) rad., while the involute angle of the wrap on the stationary scroll member is greater than that in the machine of symmetrical eccentricity wrap type by an amount in terms of radians determined by dividing the radius of revolution by the basic circle diameter, i.e. ($\epsilon$/2a) rad. Therefore, the theoretical displacement of the machine according to the invention having asymmetric wrap arrangement is equal to that of the machine having symmetrical eccentricity wrap arrangement. This means that, according to the invention, it is possible to minimize the inside diameter of the casing to a value which is equal to that in the machine of symmetrical eccentricity wrap type having the same theoretical displacement. Thus, the invention makes it possible to minimize the diameter of the casing when the values of factors such as the displacement, involute curves and the wrap height are given.

In the scroll-type fluid machine of the invention, the involute angle of the terminal end of the stationary scroll wrap is greater than the involute angle of the terminal end of the orbiting scroll wrap by 90°, if the wrap thickness t is equal to the revolution radius $\epsilon$. Under such a condition, the torque applied to the orbiting scroll member, tending to cause this member to rotate about its own axis, is minimized both in terms of the maximum value and the mean value within a range in which any counter-torque is not generated, as will be explained later. This means that the load applied to the rotation-prevention mechanism is reduce and, therefore, is highly appreciated from the view point of durability. The positions of the wrap terminal ends can be varied within given ranges as explained before, so that the difference in the involue angle between the terminal ends of both scroll wraps can be set at 90° even when the wrap thickness t differs from the radius of revolution $\epsilon$. It is also to be noted that the difference in the involute angle need not always be 90°. The reduction in the torque applied to the orbiting scroll member and in the counter-torque can be obtained when the difference in the involute angle is selected to range between 60° and 120°.

Preferably, the difference in the involute angle is selected to be slightly less than 90°, particularly between 60° and 90°, because such angle can appreciably reduce the torque acting on the orbiting scroll member without causing any substantial counter-torque.

Figure 4:
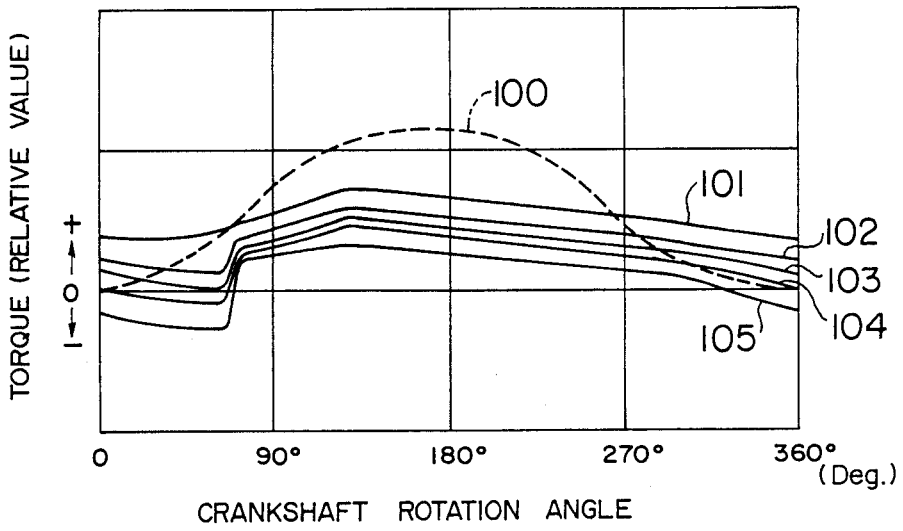
FIGS. 4 and 5 are graphs showing changes of torque applied to the orbiting scroll members of the fluid machines according to the prior art and the present invention, respectively.
Figure 5:
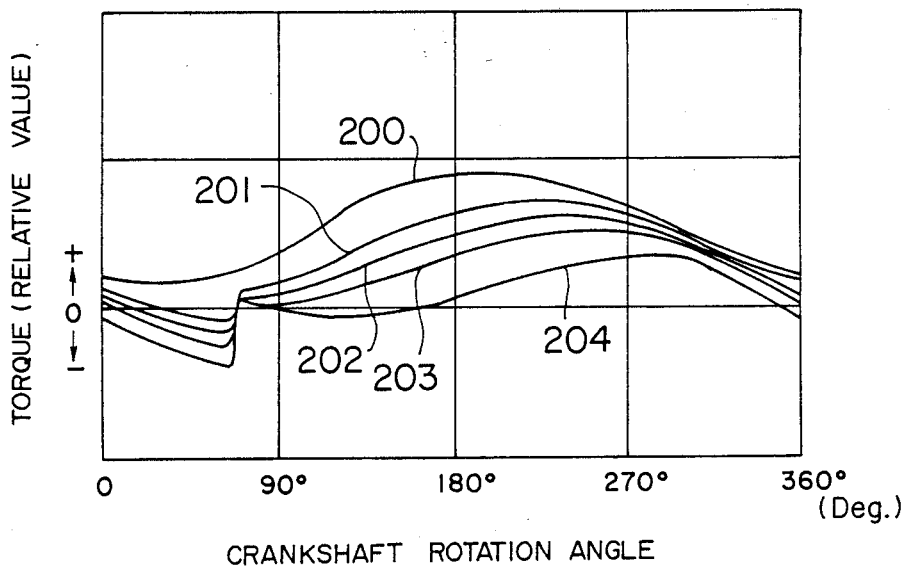

A discussion will be given hereinunder in regard to the torque applied to the orbiting scroll member with referring to FIGS. 4 and 5. As explained before, in the scroll-type fluid machine of the present invention, the involute angle $\lambda_{ef}$ of the terminal end 2*d* of the stationary scroll wrap is greater than the involute angle $\lambda_{eo}$ of the terminal end 3*d* of the orbiting scroll wrap. In addition, these terminal ends are located within the angular range $\pm\theta$. Therefore, the difference ($\lambda_{ef}-\lambda_{eo}$) in the involute angle between the terminal ends of both wraps is adjustable within a certain range. In FIG. 4, curves 101 to 105 indicate the change of torque which is applied to the orbiting scroll member tending to cause rotation of the orbiting scroll member about its own axis, as obtained when the difference ($\lambda_{ef}-\lambda_{eo}$) in the involute angle between the terminal ends of both wraps is varied. A curve 100 shows the change of torque which is exhibited in the scroll-type fluid machine of the symmetrical eccentricity wrap type. More specifically, the curve 101 shows the change in the level of the torque in relation to the crankshaft rotation angle as obtained when the difference in the involute angle is zero. Thus, the torque change shown by the curve 101 is observed in conventional scroll-type fluid machine which is known as symmetrical no-eccentricity wrap type machine. In this case, the gas pressure load applied on a point on the orbiting scroll member, which is eccentric from the center of bearing on the orbiting scroll member, i.e., the center of the eccentric shaft portion 6*a*, by an amount which equals to a half the radius of revolution $\Sigma$ of the orbiting scroll member ($\epsilon$/2). This load therefore produces a torque which tends to rotate the orbiting scroll member about its axis. The change in the torque is attributable to a change in the level of the gas pressure load applied on the orbiting scroll member.

In the symmetrical eccentricity wrap type machine, the point on the orbiting scroll member at which the gas pressure load is applied moves within a range between zero and the radius of revolution in terms of the distance from the center of the bearing on the orbiting scroll member, i.e., distance from the center of the eccentric shaft portion. The torque, therefore, varies within a range between zero and a certain maximum value which is greater than that exhibited in the symmetrical non-eccentricity type machine, as will be seen from the curve 100.

Curves 102 to 105 show the torque levels as exhibited by the scroll-type fluid machine of the present invention having asymmetric wrap arrangement when the difference in the involute angle between the terminal end of the stationary scroll wrap and the terminal end of the orbiting scroll wrap is selected to be 60°, 90°, 120° and 180°, respectively. It will be seen from FIG. 4 that when the difference in the involute angle is less than 60°, the effect in the reduction of the torque is not so appreciable as compared with the symmetrical non-eccentricity wrap type machine (curve 101). On the other hand, when the difference in the involute angle exceeds 120°, the negative torque, i.e., the counter-torque, becomes large to undesirably allow the orbiting scroll member to vibrate due to the presence of a play in the rotation prevention mechanism. For these reasons, the difference in the involute angle between the terminal end of the stationary scroll wrap and the terminal end of the orbiting scroll wrap should be determined to fall within the range between 60° and 120° which ensures a large effect in reducing the torque without being accompanied by generation of substantial counter-torque.

The highest level of the torque is exhibited by the symmetrical eccentricity wrap type machine, while the lowest level of the torque is obtained with the asymmetric non-eccentricity type machine embodying the present invention. The symmetrical non-eccentricity type machine shows an intermediate level of the torque. As to the size of the machines, the symmetrical non-eccentric wrap type machine has the greatest diameter, while the asymmetric non-eccentricity type machine of the invention has the smallest diameter. The symmetrical eccentric type machine has an intermediate size between these two types of machine. Thus, the asymmetric non-eccentricity type machine according to the present invention satisfies both the demand for the minimization of the size and reduction in the torque which acts on the orbiting scroll member tending to cause this member to rotate about its own axis.

In the asymmetric wrap type fluid machine according to the present invention, it is not essential that the center of the involute basic circle of the wrap strictly coincides with the center of the plate of the scroll member. Namely, the described advantages of the present invention are obtainable even if the center of the basic circle of the involute curve is slightly offset from the center of the plate of the scroll member. An example of such arrangement will be described with reference to FIG. 5 which shows torque levels as obtained in an asymmetric wrap wrap type machine of the invention with various amounts of difference in the involute angle between the terminal ends of both scroll members while offsetting the center of the bearing on the orbiting scroll member by an amount $\epsilon/4$ towards the terminal end of the wrap on the orbiting scroll member.

More specifically, curves 201, 202, 203 and 204 show the torque level changes when the difference in the involute angles are 60°, 90°, 120° and 180°, respectively. The curve 200 shows the torque level as obtained with the symmetrical wrap type arrangement. From FIG. 5, it will be understood that the maximum value of the torque acting on the orbiting scroll member is reduced and the level of the counter torque is comparatively small when the difference in the involute angle ranges between 60° and 120°.

In the asymmetric wrap type scroll fluid machine of the present invention, the terminal end of the wrap on the orbiting scroll member extends to the outer peripheral edge of the plate thereof, while the terminal end of the wrap on the stationary scroll member extends to a position of the inner periphery of the casing. Thus, the fluid machine has no wasteful or dead space and the diameter of the machine can be reduced to the same as that of symmetrical eccentric wrap type. In addition, it is possible to reduce the torque acting on the orbiting scroll member by selecting the involute angle of the terminal end of the stationary scroll wrap to be greater than the involute angle of the terminal end of the orbiting scroll wrap by a value which ranges between 60° and 120°. Consequently, the load applied to the rotation-prevention mechanism is reduced to ensure improved durability of the scroll-type fluid machine.

What is claimed is:

1. A scroll-type fluid machine having a cylindrical casing, a stationary scroll member and an orbiting scroll member, each of said members having a disk-shaped plate and a spiral wrap protruding upright from one end of said disk-shaped plate along an involute curve of a basic circle, said stationary scroll member and said orbiting scroll member being assembled together in the cylindrical casing such that their wraps mesh with each other, said orbiting scroll member being capable of making, without rotating about its own axis, an orbiting motiom such that a center of the basic circle on said orbiting scroll member revolves at a predetermined radius of revolution about the center of the basic circle on said stationary scroll member while keeping sliding contact between walls of the spiral wraps on both scroll members, the improvement wherein an involute angle of a terminal end of the spiral wrap on said stationary scroll member is greater than an involute angle of a terminal end of the spiral wrap on said orbiting scroll member, the center of said basic circle of the spiral wrap on said orbiting scroll member corresponds with the center of said disk-shaped plate of said orbiting scroll member while the center of said basic circle of said spiral wrap on said stationary scroll member coincides with or substantially coincides with a center axis of said casing, the terminal end of said spiral wrap on said orbiting scroll member is located substantially on an outer peripheral edge of said disk-shaped plate of said orbiting scroll member while the terminal end of said wrap on said stationary scroll member is located substantially on an inner periphery of said cylindrical casing, and an involute angle $\lambda_{ef}$ of the terminal end of said spiral wrap on said stationary scroll member and an involute angle $\lambda_{eo}$ of the terminal end of said spiral wrap on said orbiting scroll member are determined to meet the following condition:

$$60° \leqq \lambda_{ef} - \lambda_{eo} \leqq 120°.$$

2. A scroll-type fluid machine according to claim 1, wherein the terminal end of the wrap on each scroll member is located within a region angularly spaced from the center of said disk-shaped plate by $\pm\theta$ radian on respective sides of a line interconnecting said center of the basic circle and a point at which a thickness bisector involute curve of said spiral wrap intersects the peripheral edge of said disk-shaped plate, where $\theta$ is given by the given by the following formula:

$$\theta = \frac{\pi t}{2(\epsilon + t)},$$

where:

$\epsilon$=a radius of revolution of said orbiting scroll member, and t=a thickness of said spiral wrap.

3. A scroll-type fluid machine according to claim 1, wherein a location of the terminal ends of the orbiting scroll member and stationary scroll member are respectively determined in accordance with the following conditions:

$$2(a\lambda_{eo}-t)<D_O\leqq 2a\lambda_{eo},$$

$$2(a\lambda_{ef}-t)<D_f\leqq 2a\lambda_{ef},$$

where:

$D_O$=a diameter of the disk-shaped plate of said orbiting scroll member, $D_f$=a diameter of the disk-shaped plate of said stationary scroll member, a=the radius of the basic circle of the involute circle of the wraps of said scroll member, and t=a thickness of the respective wraps of the scroll members.

4. A scroll-type fluid machine comprising a stationary scroll member and an orbiting scroll member, each of said scroll members having a disk-shaped plate and an involute spiral wrap protruding upright from one end of said disk-shaped plate, a casing means for accommodating both of said scroll members, a rotation prevention means for preventing said orbiting scroll member from rotating about its own axis, a center of a basic circle of an involute curve of said spiral wrap on said orbiting scroll member coincides with a center of said disk-shaped plate of said orbiting scroll member while a center of a basic circle of an involute curve of said spiral wrap on said stationary scroll member coincides with or substantially coincides with a center axis of said casing means, a terminal end of said spiral wrap on said orbiting scroll member is located substantially on an outer peripheral edge of said disk-shaped plate of said orbiting scroll member, and an involute angle $\lambda_{ef}$ of the terminal end of said spiral wrap on said stationary scroll member and involute angle $\lambda_{eo}$ of the terminal end of said spiral wrap on said orbiting scroll member are determined to meet the following condition:

$$60^\circ\leqq\lambda_{ef}-\lambda_{eo}\leqq 120^\circ.$$

5. A scroll-type fluid machine according to claim 4, wherein the following condition is met:

$$60^\circ\leqq\lambda_{ef}-\lambda_{eo}\leqq 90^\circ.$$

6. A scroll-type fluid machine according to claim 4, wherein the involute angle $\lambda_{eo}$ of the terminal end of said spiral wrap on said orbiting scroll member is determined to be less than the involute angle $l_{ef}$ of the terminal end of said spiral wrap on said stationary scroll member by an angle which is substantially equal to or slightly less than 90°.

7. A scroll-type fluid machine comprising:

a casing;

a stationary scroll member accommodated in said casing having a disk-shaped plate and an involute spiral wrap protruding upright from one end of said disk-shaped plate, a center of a basic circle of the involute curve coinciding with a center axis of said casing surrounding said disk-shaped plate, a terminal end of said spiral wrap being located substantially on an inner periphery of said casing; and an orbiting scroll member accommodated in said casing having a disk-shaped plate and an involute spiral wrap protruding upright from one end of said disk-shaped plate and meshing with said spiral wrap of said stationary scroll member, a center of a basic circle of the involute curve coinciding with a center of said disk-shaped plate of said orbiting scroll member, a terminal end of said spiral wrap being located on a peripheral edge of said disk-shaped plate of said orbiting scroll member, an involute angle of the terminal end of said spiral wrap of said orbiting scroll member being less than an involute angle of the terminal end of said spiral wrap of said stationary scroll member by an angle which is substantially equal to or slightly less than 90°.

8. A scroll-type fluid machine comprising:

a casing;

a stationary scroll member accommodated in said casing having a disk-shaped plate and an involute spiral wrap protruding upright from one end of said plate, a center of a basic circle of the involue curve coinciding with a center axis of said casing surrounding said disk-shaped plate, a terminal end of said spiral wrap being located substantially on an inner periphery of said casing; and an orbiting scroll member accommodated in said casing having a disk-shaped plate and an involute spiral wrap protruding upright from one end of said disk-shaped plate and meshing with said spiral wrap of said stationary scroll member, a center of a basic circle of the involute curve coinciding with a center of said disk-shaped plate of said orbiting scroll member, a terminal end of said spiral wrap is located on a peripheral edge of said disk-shaped plate thereof with a thickness of the spiral wrap of said orbiting scroll member being substantially equal to a radius of revolution of said orbiting scroll member, and an involute angle of the terminal end of said spiral wrap of said orbiting scroll member is less than an involute angle of the terminal end of said spiral wrap of said stationary scroll member.

* * * * *